US009147979B1

(12) United States Patent
Chung et al.

(10) Patent No.: US 9,147,979 B1
(45) Date of Patent: Sep. 29, 2015

(54) ELECTRIC CONNECTOR

(71) Applicant: Kuang Ying Computer Equipment Co., Ltd., New Taipei (TW)

(72) Inventors: Hsuan-Ho Chung, New Taipei (TW); Yu-Hung Lin, New Taipei (TW); Kuang-Shan Li, New Taipei (TW)

(73) Assignee: Kuang Ying Computer Equipment Co., Ltd., New Taipei (TW)

( * ) Notice: Subject to any disclaimer, the term of this patent is extended or adjusted under 35 U.S.C. 154(b) by 0 days.

(21) Appl. No.: 14/483,132

(22) Filed: Sep. 10, 2014

(51) Int. Cl.

| | |
|---|---|
| ***H01R 13/648*** | (2006.01) |
| ***H01R 13/6581*** | (2011.01) |
| ***H01R 12/72*** | (2011.01) |
| ***H01R 13/6594*** | (2011.01) |

(52) U.S. Cl.
CPC ..... *H01R 13/6581* (2013.01); *H01R 12/727* (2013.01); *H01R 13/6594* (2013.01)

(58) Field of Classification Search
CPC ..... H01R 13/65802; H01R 23/7073
USPC ..... 439/607.01, 607.13, 660
See application file for complete search history.

(56) References Cited

U.S. PATENT DOCUMENTS

| | | | | |
|---|---|---|---|---|
| 8,307,228 | B2 * | 11/2012 | Shen | 713/320 |
| 8,425,261 | B2 * | 4/2013 | Pepe | 439/676 |
| 2008/0153353 | A1 * | 6/2008 | Hu et al. | 439/610 |
| 2010/0227509 | A1 * | 9/2010 | He et al. | 439/638 |
| 2011/0143605 | A1 * | 6/2011 | Pepe | 439/676 |
| 2012/0329322 | A1 * | 12/2012 | Ao et al. | 439/607.01 |

* cited by examiner

*Primary Examiner* — Phuongchi T Nguyen
(74) *Attorney, Agent, or Firm* — Leong C. Lei

(57) ABSTRACT

An electric connector includes at least one transmission conductor group, a plurality of contacts formed at an end of the transmission conductor group and up and down alternating each other, and adaption sections formed at an end of the transmission conductor group distant from the contacts and are arranged in groups each including at least four adaption sections juxtaposing each other. The transmission conductor group includes a plurality of high-frequency differential signal transmission conductor pairs, a plurality of power transmission conductor pair, and a plurality of low-frequency signal transmission conductors. With the above arrangement, the contact of the transmission conductor group is arranged in two rows alternating each other so that the insertion between the male and female connectors is directionless. The adaption sections are set in a secured juxtaposing configuration by means of an annular band to show the feature of soldering free and suppressing interference.

21 Claims, 10 Drawing Sheets

ELECTRIC CONNECTOR

BACKGROUND OF THE INVENTION 1. (a) Technical Field of the Invention

The present invention generally relates to an electric connector, and more particularly to an electric connector that achieves insertability in both normal direction and reverse direction and effective suppression of interferences, such as electromagnetic interference (EMI) and radio frequency interference (RFI) by means of up and down alternating arrangement of transmission conductor group and a separation board, an annular band, and a frame that are integrally formed.

2. (b) Description of the Prior Art

The prosperity of the electronic industry brings the demand of connectors for almost all the electronic products. Universal serial bus (USB) that is most commonly used in the market is an association defined standard interface specification for connectors. Such a specification is the most commonly used one and there are various improvements derived for the connectors, among which the most simple and easiest one is bidirectional insertability of connectors. Since mating between a male portion and a female portion of a connector is generally allowed in a fixed direction, due to various factors, such as inadvertency, during the operation by a user, it is often that insertion in an opposite direction occurs. Such an unexpected situation may cause a consequence of damaging the terminal pins of the connector, or even electrical shorting that destructs electronic facility. Thus, the bidirectional insertion connectors proposed by the manufacturers are indeed an improvement of convenience and usefulness.

However, such an improvement is limited to the specification of USB2.0. With the quick development of the modern technology, progress is made everyday. Connectors, such as USB2.0, USB3.0, Type-A, and Type-B, must advance with time in respect of for example increase of transmission speed and upgrading of hardware specification. However, such a bidirectional insertion connector is only applicable to USB2.0 and is not suitable for more advanced connectors.

Thus, it is a goal that the present inventor and those involved in the business are eager to achieve for overcoming the problems and drawbacks of the bidirectional insertion connector.

SUMMARY OF THE INVENTION

In view of the above-discussed drawbacks, the present invention aims to provide an electric connector has a simple manufacturing process, is easy to use, has a strong structure, and has low interference.

The primary object of the present invention is to achieve insertability in normal direction and reverse direction by means of two rows of alternately arranged contact of a transmission conductor group, to improve the easiness of a manufacturing process through using a single row soldering free adaption sections of the transmission conductor group, and to alleviate the occurrence of problems, such as electromagnetic interference and radio frequency interference by means of a shielding housing, an inclined lid section, a separation board, an annular band, and a frame.

To achieve the above object, the present invention comprises a structure that comprises a transmission conductor group that comprises a plurality of high-frequency differential signal transmission conductor pairs, a plurality of power transmission conductor pair, and a plurality of low-frequency signal transmission conductors. A plurality of up and down alternating contacts is formed at one end of the transmission conductor group and a plurality of adaption sections that are formed at an end of the transmission conductor group distant from the contacts and are arranged in groups each comprising at least four adaption sections juxtaposing each other. Components, such as a separation board and an annular band, are also included. Thus, in the manufacture of the present invention at a manufacturing side, the contacts are arranged at upper and lower sides of the separation board in an alternate configuration. The end of the transmission conductors that is distant from the contacts forms soldering-free elastic adaption sections that are arranged in a single row. The annular band is used to secure and fix the structural arrangement of the adaption sections. As such, the present invention is capable of insertion in both normal direction and reverse direction and can reduce the mutual interference between the terminals of the upper and lower rows. Further, through proper arrangements of the high-frequency differential signal transmission conductor pairs, the power transmission conductor pair, and low-frequency signal transmission conductors, the present invention is applicable to different specifications of USB.

With the above-described technique, the problems that the conventional bidirectional insertion connectors still require soldering, have a relatively difficult manufacturing process, have a high noise interference, and the range of application of the connector is not good can be overcome to achieve the above-discussed advantages.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
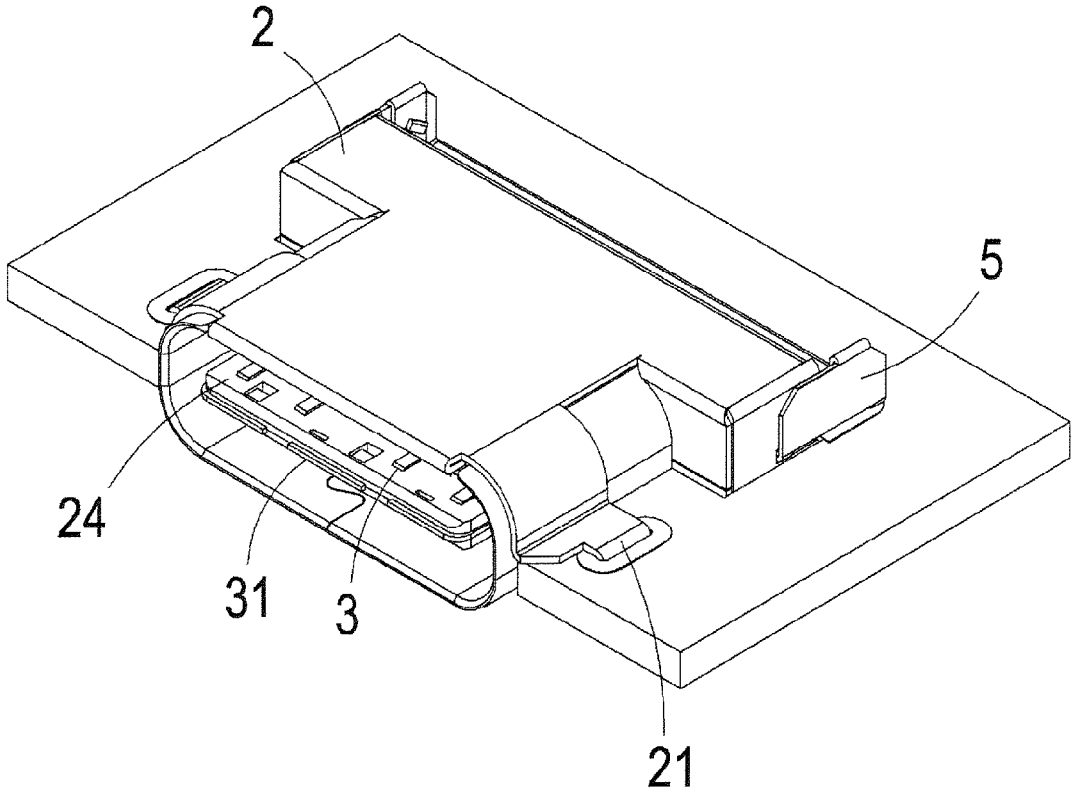
FIG. 1 is a perspective view of a preferred embodiment of the present invention.
Figure 2:
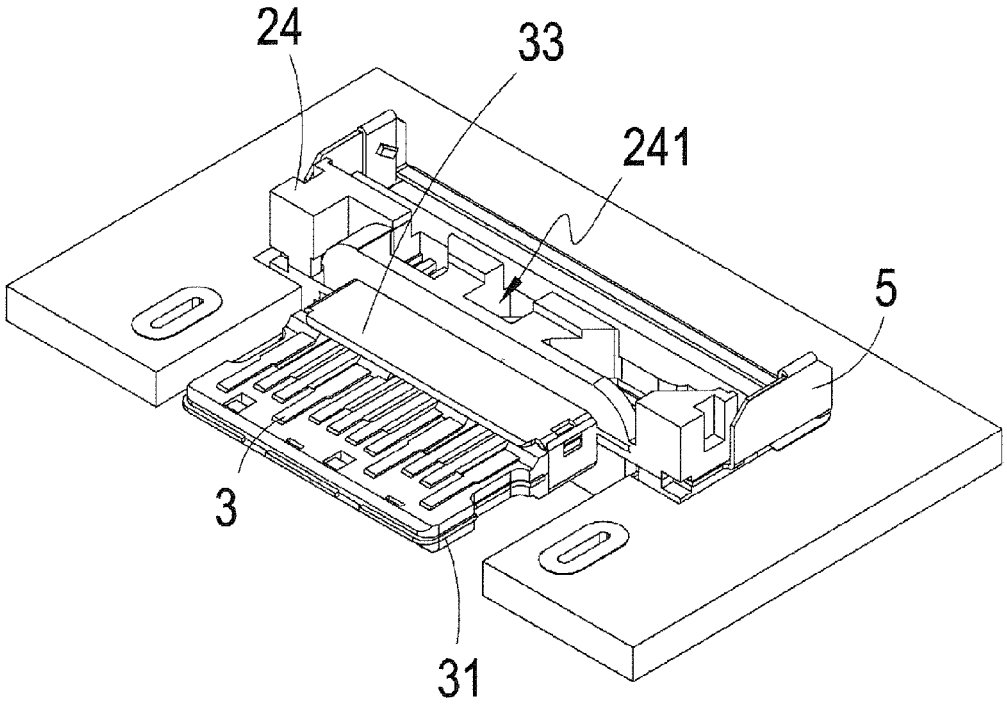
FIG. 2 is a perspective view showing an interior structure of the preferred embodiment of the present invention.
Figure 3:
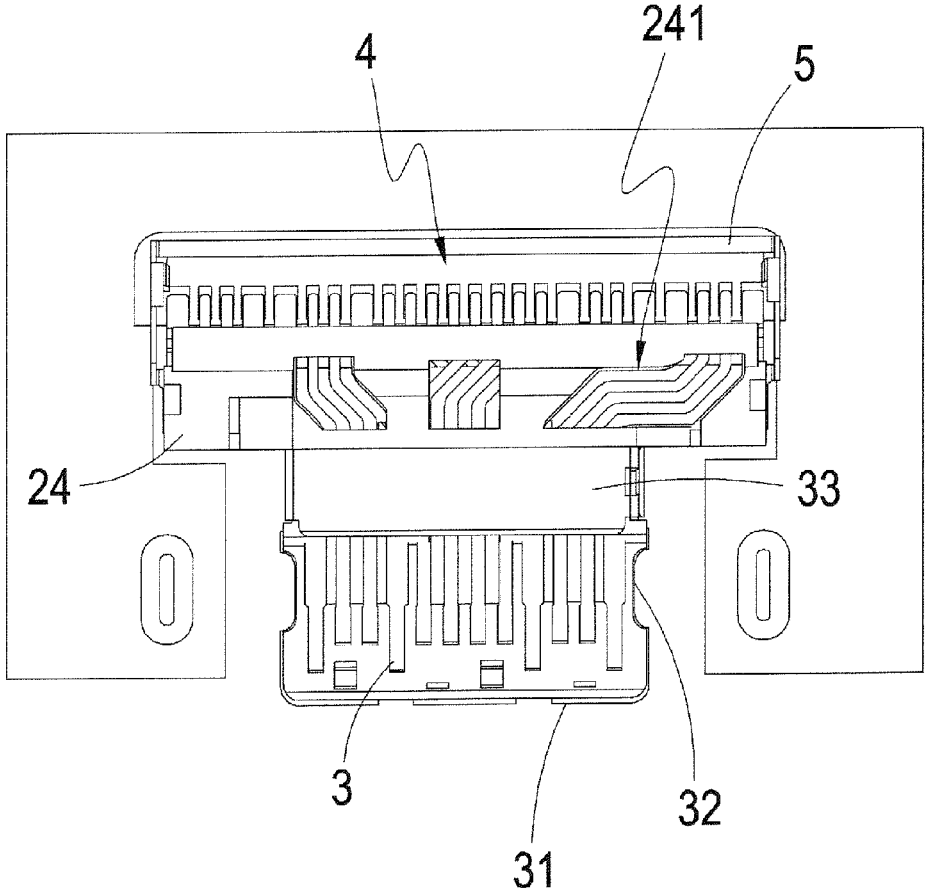
FIG. 3 is a top plan view showing the interior structure of the preferred embodiment of the present invention.
Figure 4:
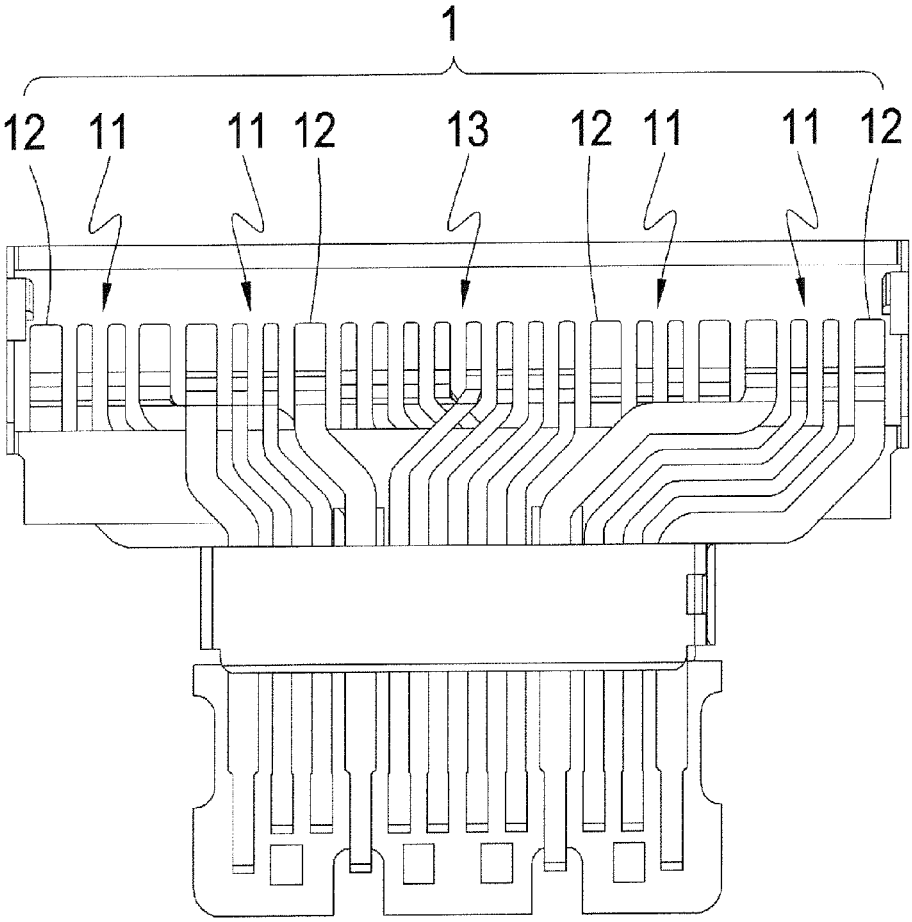
FIG. 4 is a schematic view showing an arrangement of transmission conductors of the preferred embodiment of the present invention.

Referring to FIGS. 1, 3, and 4, which are respectively is a perspective view of a preferred embodiment of the present invention, a top plan view showing an interior structure of the preferred embodiment of the present invention, and a schematic view showing an arrangement of transmission conductors of the preferred embodiment of the present invention, the drawings clearly show a connector according to the present invention, which is illustrated as a female connector and comprises:

at least one transmission conductor group 1, wherein the transmission conductor group 1 comprises a plurality of high-frequency differential signal transmission conductor pairs 11, a power transmission conductor pair 12 respectively set on opposite sides of the high-frequency differential signal transmission conductor pairs 11, and a plurality of low-frequency signal transmission conductors 13 arranged in the middle of the high-frequency differential signal transmission conductor pairs 11;

a shielding housing 2, which receives the transmission conductor group 1 therein, the shielding housing 2 having two sides that are each provided with an insertion type soldering pin 21;

an insulation body 24, which is mounted to the transmission conductor group 1, the insulation body 24 comprising at least one hollowed section 241 for adjustment of impedance;

a plurality of contacts 3, which is arranged at one end of the transmission conductor group 1 in the form of plates that are up and down alternate with each other, the contacts 3 receiving therebetween a separation board 31 for isolation of signal, the separation board 31 having two sides each provided with at least one recess 32 for grounding and retention, the contacts 3 being provided with an annular band 33, the annular band 33 being in electrical connection with the shielding housing 2 for grounding and helping reinforce and fix the contacts 3; and adaption sections 4, which are formed at an end of the transmission conductor group 1 that is distant from the contacts 3 and are arranged in groups each comprising at least four adaption sections juxtaposing each other, the adaption sections 4 is connectable, in a soldering-free elastic configuration, to a printed circuit Board (PCB) or a chip on board (COB), the adaption sections 4 being provided with a frame 5 surrounding sides thereof.

Figure 5:
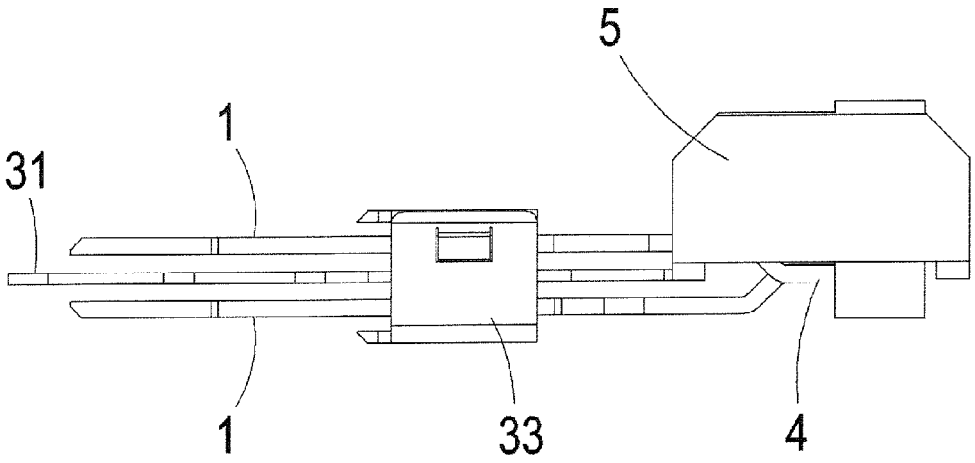
FIG. 5 is another schematic view showing the arrangement of transmission conductors of the preferred embodiment of the present invention.

Referring to FIGS. 1-5, which are respectively a perspective view of a preferred embodiment of the present invention, a perspective view showing an interior structure of the preferred embodiment of the present invention, a top plan view showing the interior structure of the preferred embodiment of the present invention, a schematic view showing an arrangement of transmission conductors of the preferred embodiment of the present invention, and another schematic view showing the arrangement of transmission conductors of the preferred embodiment of the present invention, firstly, it is clearly seen from FIG. 1 that the transmission conductor group 1 and the insulation body 24 are both received in the shielding housing 2. The shielding housing 2 is completely closed except the contacts 3 that are exposed through an opening formed in a front end thereof for insertion and the adaption sections 4 exposed at a rear end thereof in order to enhance the performance of isolating inside/outside noises. The two sides of the shielding housing 2 are each provided with an insertion type soldering pin 21. The adaption sections 4 are provided with a frame 5 by sides thereof. The soldering pins 21 and the frame 5 allow for soldering and fixing of the electrical connector to a printed circuit board (PCB) or a chip on board (COB). In the instant embodiment, a printed circuit board is taken as an example. Then, referring to FIGS. 2 and 3, a separation board 31 is arranged between the up and down alternating contacts 3. Since the transmission conductor group 1 may carry high-frequency signals, the separation board 31 that isolates the upper row and lower row of the terminals helps alleviate the EMI and RFI issues. Further, the separation board 31 is provided, on two sides thereof, with recesses 32 for retention of a male connector inserted therein. Further, the annular band 33 is provided to make the positional relationship among the terminals of the transmission conductor group 1 stable and fixed. The frame 5 comprises elongate soldering sections that are connected to the circuit substrate for grounding thereby indirectly enhancing the performance of isolation of noises and the structural strength. Further, the insulation body 24 is provided with at least one hollowed section 241, which, compared to the prior art, provides a better effect of impedance adjustment. Referring to FIGS. 4 and 5, it can be clearly seen from the drawings that the separation board 31, the annular band 33, and the frame 5 are integrally formed so as to provide an assured effect of isolation of noises of the up and down alternating contacts 3, such as EMI and RFI. The arrangement of the transmission conductor group 1 in the instant embodiment comprises two high-frequency differential signal transmission conductor pairs 11 at each of two sides, a power transmission conductor pair 12 that are respectively set on two sides of each of the high-frequency differential signal transmission conductor pairs 11 with width of the power transmission conductor pairs 12 being greater than that of the high-frequency differential signal transmission conductor pairs 11 in order to carry a large current flowing therethrough, a plurality of low-frequency signal transmission conductors 13 that is arranged exactly at the middle portion with two sides of the low-frequency signal transmission conductors 13 being provided with control signal transmission conductors or data transmission conductors. Such an arrangement is in compliance with the specification of USB3.1 Type C. However, the present invention allows for different arrangements to comply with different specifications of connectors thereby showing wider applications. Thus, the currently discussed arrangement is simply an illustrative example and the present invention is not limited thereto.

Figure 6:
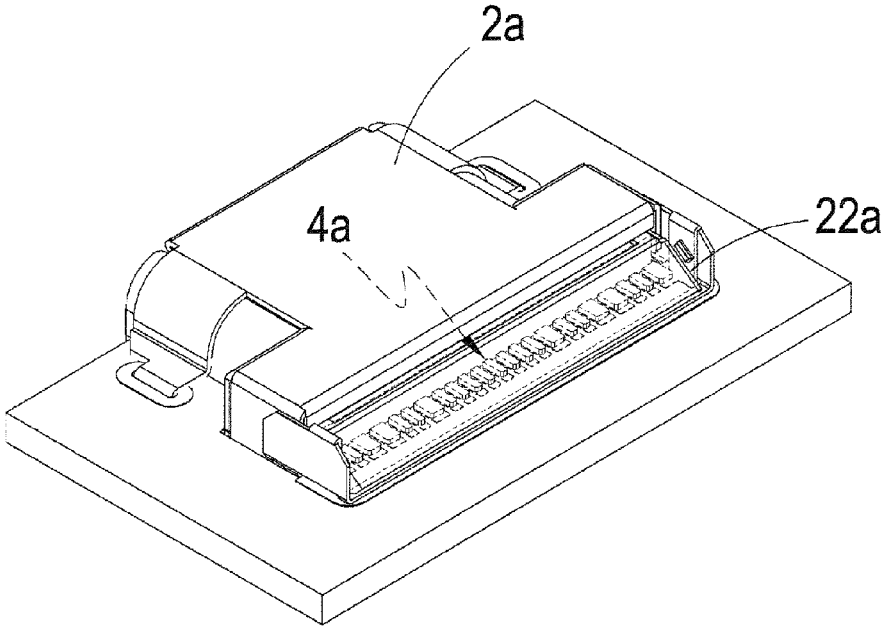
FIG. 6 is a perspective view of another embodiment of the present invention.

Referring to FIG. 6, which is a perspective view of another embodiment of the present invention, the drawing clearly shows that in the instant embodiment, a shielding housing **2*a* in the form of an incline cover is provided at one side of the adaption sections 4*a* for suppressing electromagnetic interference (EMI) or radio frequency interference (RFI), and an inclined lid 22*a* integrally formed with the shielding housing 2*a* is provided. As such, the adaption sections 4*a*** within the connector is are isolated from the surrounding so as to reduce noise interference and also to eliminate, through the integrally-formed structure, any problem induced in the manufacturing process.

Figure 7:
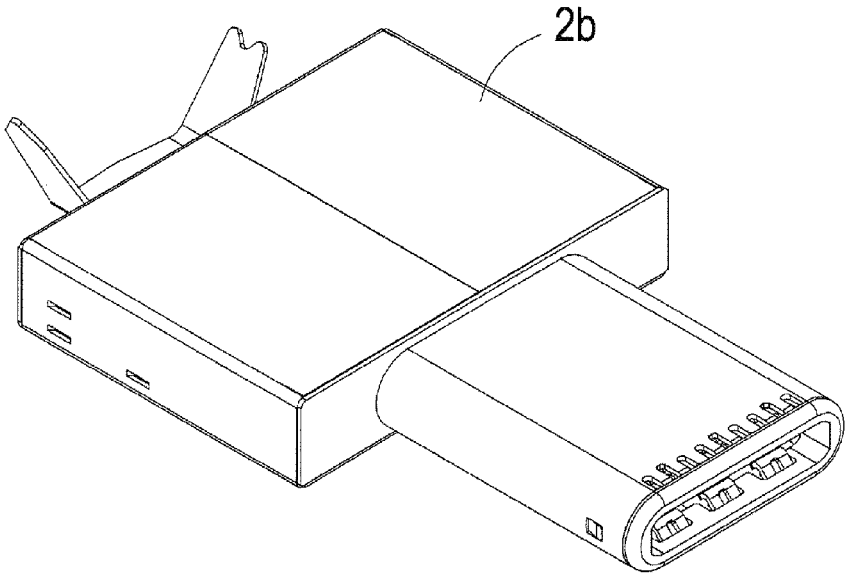
FIG. 7 is a first perspective view of a further embodiment of the present invention.
Figure 8:
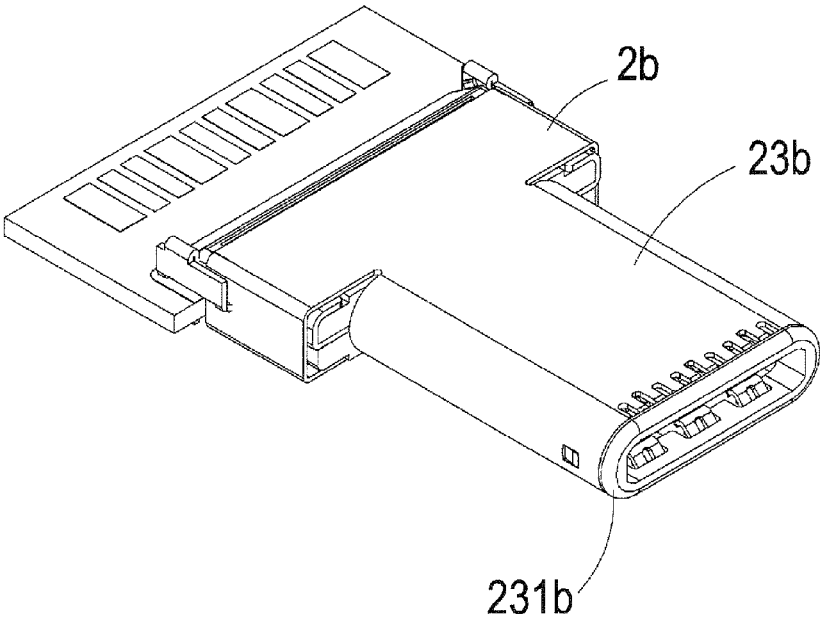
FIG. 8 is a second perspective view of a further embodiment of the present invention.
Figure 9:
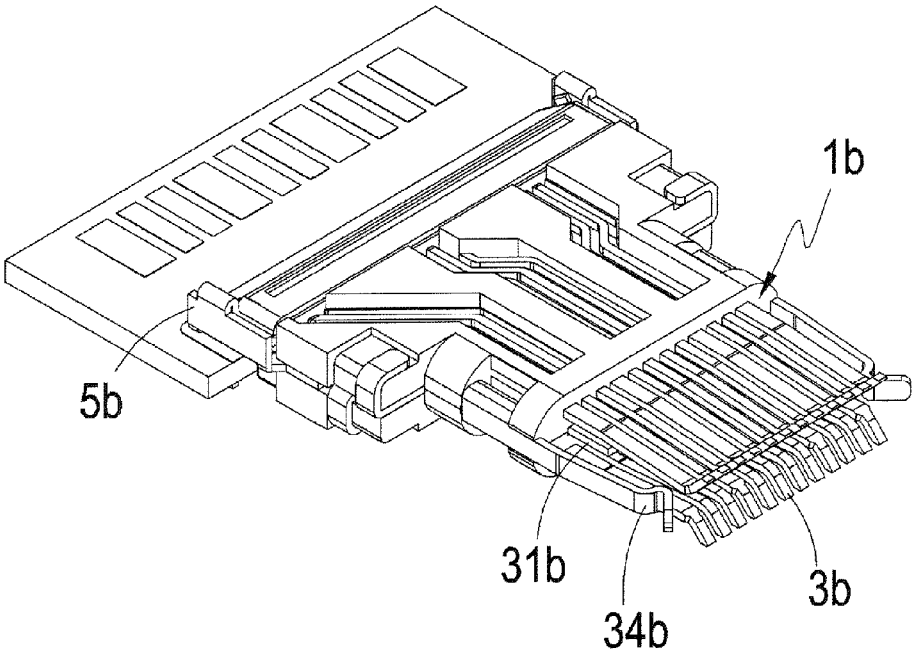
FIG. 9 is a perspective view showing an interior structure of a further embodiment of the present invention.
Figure 10:
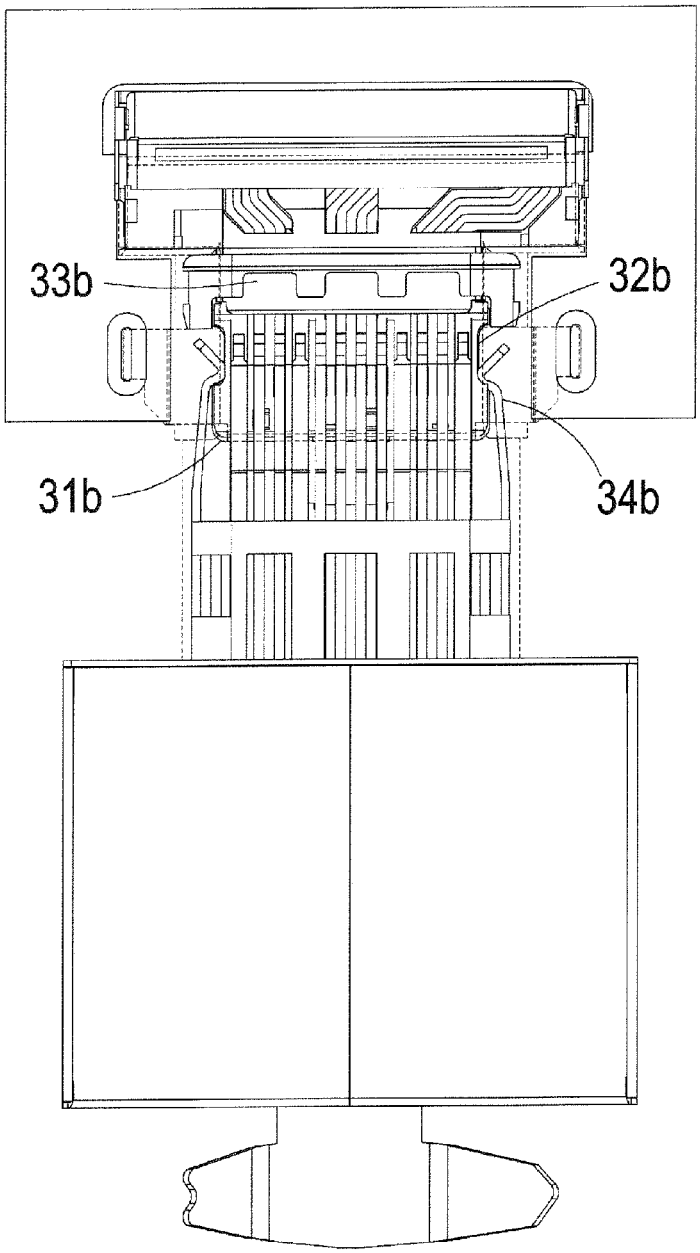
FIG. 10 is a schematic view showing a condition of use of a further embodiment of the present invention.

Referring to FIGS. 7-10, which are respectively a first perspective view of a further embodiment of the present invention, a second perspective view of a further embodiment of the present invention, a perspective view showing an interior structure of a further embodiment of the present invention, and a schematic view showing a condition of use of a further embodiment of the present invention, the drawings clearly show that the instant embodiment adopts the same arrangement of the transmission conductor group 1*b* as that of the previous embodiment and applies it to a male connector, wherein regarding the shielding housing 2*b*, as shown in FIG. 7, the shielding housing 2*b* has a rear end that can be a wire-end configuration or a closed configuration and the wire-end configuration is taken as an example in the instant embodiment. The shielding housing 2*b* has an end that is insertable into a female connector and forms a mating section 23*b*. In the configuration shown in FIG. 8, the mating section 23*b* has a width that is smaller than that of the shielding housing 2*b* and the shielding housing 2*b* has an opening that is provided with an annular plastic cover 231*b*. The annular plastic cover 231*b* provides an effect of improving sealing. As to difference in respect of the interior structure, as shown in FIG. 9, firstly, the contacts 3*b* that are formed at one end of the transmission conductor group 1*b* is arranged in a more elastic up-and-down alternating configuration and the transmission conductor group 1*b* are provided, at each of two sides thereof, with an elastic engagement pin 34*b*. The elastic engagement pins 34*b* is engageable with the recesses 32*b* of the female connector when the male connector and the female connector mate each other. The drawings clearly show that the elastic engagement pins 34*b* on the two sides of the transmission conductor group 1*b*, the separation board 31*b* between the contacts 3*b*, and the flame 5*b* circumferentially surrounding sides of the adaption sections are integrally formed so as to provide, similar to the previous embodiment, features for alleviating EMI and RFI and reducing the difficult of manufacturing. Finally, as shown in FIG. 10, which is a schematic view showing a condition of use when the male connector and the female connector mate each other, the drawing clearly shows the condition where the elastic engagement pins 34*b* engages in the recesses 32*b*. As such, the frame 5*b*, the separation board 31*b*, and the elastic engagement pins 34*b* of the male connector and the separation board 31*b*, the annular band 33*b*, and the frame 5*b* of the female connector collectively establishing a grounding condition to thereby providing an effect of improving noise isolation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An electric connector, comprising:

at least one transmission conductor group, the transmission conductor group comprises a plurality of high-frequency differential signal transmission conductor pairs, a power transmission conductor pair respectively set on opposite sides of the high-frequency differential signal transmission conductor pairs, and a plurality of low-frequency signal transmission conductors arranged in the middle of the high-frequency differential signal transmission conductor pairs;

a plurality of contacts, which is arranged at one end of the transmission conductor group and is up and down alternate with each other; and adaption sections, which are formed at an end of the transmission conductor group that is distant from the contacts and are arranged in groups each comprising at least four adaption sections juxtaposing each other; and the contacts comprise one of a ground contact.

2. The electric connector according to claim 1, wherein the contacts comprise a separation board arranged therebetween for isolation of signal and the separation board has two sides each forming at lest one recess for grounding and retention.

3. The electric connector according to claim 1, wherein the adaption sections is provided with a frame surrounding sides thereof for grounding and the frame is soldered to a circuit substrate for grounding.

4. The electric connector according to claim 1, wherein the adaption sections are connectable to a printed circuit board (PCB) or a chip on board (COB).

5. The electric connector according to claim 1, wherein the power transmission conductor pair has a width greater than width of the high-frequency differential signal transmission conductor pairs to carry a large current flowing therethrough.

6. The electric connector according to claim 1, wherein the transmission conductor group comprises an insulation body mounted thereto and the insulation body comprises at least one hollowed section formed therein for impedance adjustment.

7. The electric connector according to claim 1, wherein the adaption sections are in a form of solder-free elastic configuration.

8. The electric connector according to claim 1, wherein the transmission conductor group is received in a shielding housing and the shielding housing is provided with an inclined lid at the end thereof associated with the adaption sections for suppressing electromagnetic interference and radio frequency interference, the shielding housing and the inclined lid being integrally formed.

9. The electric connector according to claim 1, wherein the adaption sections are provided at one side thereof with a shielding housing in the form of an inclined cover for suppressing electromagnetic interference and radio frequency interference.

10. The electric connector according to claim 9, wherein the shielding housing is of a wire-end configuration or a closed configuration.

11. The electric connector according to claim 1, wherein the transmission conductor group is received in a shielding housing and the shielding housing has two sides each provided with an insertion type soldering pin.

12. The electric connector according to claim 11, wherein the shielding housing is of a wire-end configuration or a closed configuration.

13. The electric connector according to claim 11, wherein the shielding housing has one end forming a mating section, the mating section having a width less than a width of the shielding housing.

14. An electric connector, which is a male connector, comprising:

at least one transmission conductor group, the transmission conductor group comprises a plurality of high-frequency differential signal transmission conductor pairs, a power transmission conductor pair respectively set on opposite sides of the high-frequency differential signal transmission conductor pairs, and a plurality of low-frequency signal transmission conductors arranged in the middle of the high-frequency differential signal transmission conductor pairs;

a plurality of contacts, which is arranged at one end of the transmission conductor group and is up and down alternate with each other and is elastic; and adaption sections, which are formed at an end of the transmission conductor group that is distant from the contacts and are arranged in groups each comprising at least four adaption sections juxtaposing each other; and the contacts comprise one of a ground contact.

15. The electric connector according to claim 14, wherein the transmission conductor group is received in a shielding housing and the shielding housing has an opening where an annular plastic cover is mounted for improving sealing.

16. The electric connector according to claim 14, wherein the transmission conductor group has two sides each provided with an elastic engagement pin adapted to engage with a female connector.

17. The electric connector according to claim 16, wherein the adaption sections is provided with a frame surrounding sides thereof for grounding and the contacts comprise a separation board arranged therebetween for isolation of signal, the elastic engagement pin, the separation board, and the frame being integrally formed.

18. An electric connector, which is a female connector, comprising:

at least one transmission conductor group, the transmission conductor group comprises a plurality of high-frequency differential signal transmission conductor pairs, a power transmission conductor pair respectively set on opposite sides of the high-frequency differential signal transmission conductor pairs, and a plurality of low-frequency signal transmission conductors arranged in the middle of the high-frequency differential signal transmission conductor pairs;

a plurality of contacts, which is arranged at one end of the transmission conductor group and is up and down alternate with each other and is in the form of plates; and adaption sections, which are formed at an end of the transmission conductor group that is distant from the contacts and are arranged in groups each comprising at least four adaption sections juxtaposing each other; and the contacts comprise one of a ground contact.

19. The electric connector according to claim 18 wherein the transmission conductor group is received in a shielding housing and J~ the contacts is provided with an annular band, the annular band being electrically connected to the shielding housing for grounding and also reinforcing and fixing the contacts.

20. The electric connector according to claim 19, wherein the contacts comprise a separation board arranged therebetween for isolation of signal and the separation board has two sides each forming a recess for grounding and retention.

21. The electric connector according to claim 20, wherein the adaption sections is provided with a frame surrounding sides thereof for grounding and he shielding housing, the separation board, the annular band, and the frame are integrally formed.

* * * * *